US011150058B2

(12) United States Patent
Hartigan et al.

(10) Patent No.: US 11,150,058 B2
(45) Date of Patent: Oct. 19, 2021

(54) REMOTE IGNITION DEVICE PROVIDING VISUAL INDICATION OF A STRIKE

(71) Applicant: Target Flares, LLC, Corpus Christi, TX (US)

(72) Inventors: Timothy Hartigan, Corpus Christi, TX (US); Bradley Bartilson, Corpus Christi, TX (US)

(73) Assignee: TARGET FLARES, LLC, Corpus Christi, TX (US)

( * ) Notice: Subject to any disclaimer, the term of this patent is extended or adjusted under 35 U.S.C. 154(b) by 250 days.

(21) Appl. No.: 15/480,061

(22) Filed: Apr. 5, 2017

(65) Prior Publication Data

US 2017/0292817 A1 Oct. 12, 2017

Related U.S. Application Data

(60) Provisional application No. 62/319,062, filed on Apr. 6, 2016.

(51) Int. Cl.
*F41J 5/24* (2006.01)

(52) U.S. Cl.
CPC ..... *F41J 5/24* (2013.01)

(58) Field of Classification Search
CPC ..... F41J 5/24; F41J 5/14; F41J 5/00; F42C 15/29; B65D 81/3211
USPC ..... 102/275.11, 345, 352, 360; 126/263.01
See application file for complete search history.

(56) References Cited

U.S. PATENT DOCUMENTS

| | | | | |
|---|---|---|---|---|
| 981,073 A * | 1/1911 | Dowd | F42D 1/04 102/275.6 |
| 1,321,849 A * | 11/1919 | Reardon | F41J 5/24 463/53 |
| 1,389,977 A * | 9/1921 | Peters | F41J 5/24 273/382 |
| 2,427,901 A * | 9/1947 | Clark | F41J 9/02 273/373 |
| 2,546,964 A | 4/1951 | Blackford et al. | |
| 2,914,062 A * | 11/1959 | Del Raso | A47J 36/30 126/263.01 |

(Continued)

FOREIGN PATENT DOCUMENTS

| | | | |
|---|---|---|---|
| GB | 2472571 A * | 2/2011 | C06B 29/08 |
| WO | 0235175 A1 | 5/2002 | |

OTHER PUBLICATIONS

"Make Exploding Targets for Airsoft and BB Buns Using Mousetraps and Fireworks" included as How_to_Make_Exploding_Targets_for_Airsoft_guns_2013.pdf & found at: https://nighthawkinlight.wonderhowto.com/how-to/make-exploding-targets-for-airsoft-and-bb-guns-using-mousetraps-and-fireworks-0144193/ (Year: 2013).*

*Primary Examiner* — Avinash A Savani
*Assistant Examiner* — Martha M Becton
(74) *Attorney, Agent, or Firm* — BakerHostetler

(57) ABSTRACT

A remote ignition device includes an igniter element, a fuel/oxidizer element, and a smoke generating element. Each of the igniter element, the fuel/oxidizer element, and the smoke generating element is configured in a layered configuration such that impact of the igniter element causes ignition of the fuel/oxidizer element and further causes the smoke generating element to release a visible smoke. Shooting targets incorporating the remote ignition device and methods of making the remote ignition device are also described.

9 Claims, 5 Drawing Sheets

(56) References Cited

U.S. PATENT DOCUMENTS 3,330,561 A * 7/1967 Kandel ..... F41J 5/00 273/378
4,243,228 A * 1/1981 Marcella ..... F41J 5/24 273/363
4,498,677 A * 2/1985 Dapkus ..... F41J 5/24 102/335
4,921,256 A * 5/1990 Gearhart ..... F41J 1/01 273/378
4,949,702 A * 8/1990 Suzuki ..... F24V 30/00 126/263.01
5,575,479 A * 11/1996 Ayres ..... F41J 9/165 273/363
7,562,627 B2 * 7/2009 Voigt ..... F42B 4/24 102/217
7,993,692 B2 * 8/2011 Finley ..... B65D 77/046 426/112
8,475,168 B2 * 7/2013 Segall ..... F41J 5/24 434/22
8,561,792 B2 * 10/2013 Young ..... F24V 30/00 206/222
8,814,167 B2 * 8/2014 Davis, Jr. ..... F41J 5/24 273/378
8,814,168 B2 * 8/2014 Davis, Jr. ..... F41J 5/24 273/380
8,915,737 B2 * 12/2014 Segall ..... F41J 5/02 434/22
9,494,391 B1 * 11/2016 Broadbent ..... F41J 1/01
9,714,199 B2 * 7/2017 Meeker ..... C06B 45/12
9,851,125 B2 * 12/2017 Arnold ..... A45C 11/20
9,879,882 B2 * 1/2018 Young ..... A45D 40/261
10,288,390 B2 * 5/2019 Meeker ..... F42B 33/001
10,386,161 B1 * 8/2019 Snell ..... F41J 5/24
10,809,041 B1 * 10/2020 Weigel ..... F41J 5/24
2002/0104527 A1 * 8/2002 Ichikawa ..... A47J 36/28 126/263.05
2008/0054570 A1 * 3/2008 Potterfield ..... F41J 5/24 273/403
2012/0202175 A1 * 8/2012 Segall ..... F41G 3/2655 434/22
2013/0009364 A1 * 1/2013 Forness ..... F41J 5/24 273/383
2013/0038020 A1 * 2/2013 Davis, Jr. ..... F41J 5/24 273/378
2013/0228974 A1 * 9/2013 Davis, Jr. ..... F41J 5/26 273/378
2014/0170300 A1 6/2014 Green

* cited by examiner

REMOTE IGNITION DEVICE PROVIDING VISUAL INDICATION OF A STRIKE

RELATED APPLICATION

The present application claims the benefit of U.S. Provisional Application Ser. No. 62/319,062, filed Apr. 6, 2016, the contents of which are incorporated herein by this reference in its entirety.

FIELD OF THE DISCLOSURE

The present disclosure relates to shooting targets, and in particular to shooting a remote ignition device that provides a visual indication of impact in the form of smoke.

BACKGROUND OF THE DISCLOSURE

Traditional shooting targets provide minimal indication of impact. For example paper range targets reveal only a small hole in the target, which is observed only with the use of a spotting scope. As another example, moving targets, e.g., clay pigeons, indicate impact with broken remnants of the clay structure.

Recent developments include exploding, stationary targets, e.g., tannerite targets described in a Spencer Ackerman article published by Wired.com on Apr. 17, 2013. However, a tannerite exploding target may include a large, single target, which has no indication of accuracy but instead indicates a single response as to hit or miss on a large area such as with a visual "flash" and an audible "bang" which lasts very briefly (<1 second).

Moving targets are described in U.S. Patent Application Publication No. 2010/0275802 to Green, et al. (Green). In particular, Green describes a clay pigeon having a flash and bang indication of target hit. However, Green also presents only a brief indication of a hit. The described chemistry of Green's device is for a visual 'flash' and audible response. However, Green's device provides neither a smoking nor a long duration response. The centric shape and large size of the conventional indicating targets also provide minimal feedback as to the accuracy of the hit. The impact energy required to initiate the effect also places limitations on the use of the target responding devices, e.g., requiring a high impact project such as a rifle or shotgun limits use to qualified target shooting ranges.

These and other shortcomings of the prior art are addressed by aspects of the present disclosure.

BRIEF DESCRIPTION OF THE FIGURES

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

SUMMARY

Figure 1A:
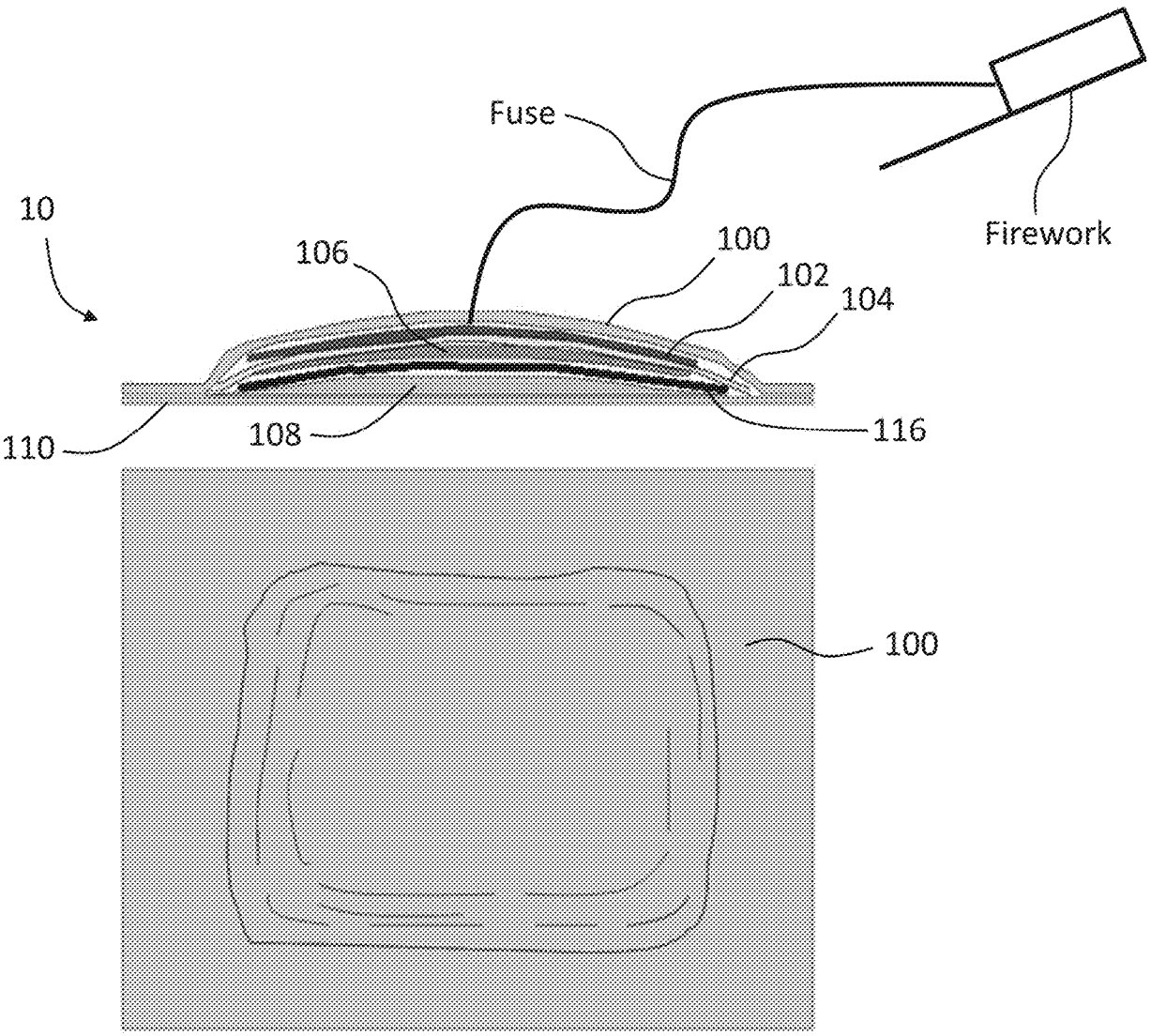
FIGS. 1A and 1B provide top and cross-sectional views of an example remote ignition device according to aspects of the disclosure.

The disclosure relates to smoking remote ignition devices and methods of using the same. In an aspect, a smoking remote ignition device exhibits a long-standing (>5 sec.), color-indicating smoke response to a successful target hit. With typical smoke duration of the presented disclosure being on the order of 20 seconds or more, there is thus sufficient time for others to be communicated with and observe the response. The size and packaging of the articles of the present disclosure also allow for far greater indication of accuracy and a wider range of targets. The simple packaging of the articles of the present disclosure lend to mass production and low cost.

The disclosure relates to a solution for impact-generated smoke in a flat form factor to address the aforementioned desired characteristics (increased indication of accuracy, flexibility in target design, and low cost). The design also presents a low-impact generating smoking device, e.g., is initiated by pellet gun. The articles of the present disclosure incorporate a safe design for shipping and handling. The compositions, articles, and methods of the disclosure may also be used to initiate combustion of other devices.

Aspects of the disclosure relate to a remote ignition device comprising an igniter element; a fuel/oxidizer element; and a smoke generating element. Each of the igniter element, the fuel/oxidizer element, and the smoke generating element is configured in a layered configuration such that impact of the igniter element causes ignition of the fuel/oxidizer element and further causes the smoke generating element to release a visible smoke.

Aspects of the disclosure further relate to a remote ignition device comprising an igniter element configured to face a source of a projectile and a fuel/oxidizer element and a smoke generating element disposed adjacent the igniter element. Each of the igniter element, the fuel/oxidizer element, and the smoke generating element is configured in a stacked configuration such that impact of the igniter element causes ignition of the fuel/oxidizer element and further causes the smoke generating element to release a visible smoke.

Certain aspects of the disclosure relate to a method of making a remote ignition device comprising: disposing a fuel/oxidizer element and a smoke generating element adjacent an igniter element; and packaging each of the fuel/oxidizer element, the smoke generating element, and the igniter element in a stacked configuration such that impact of the igniter element causes ignition of the fuel/oxidizer element and further causes the smoke generating element to release a visible smoke.

DETAILED DESCRIPTION

The present disclosure can be understood more readily by reference to the following detailed description of the disclosure and the examples included therein. In various aspects, the present disclosure pertains to an article, such as a remote ignition device, including an igniter element, a fuel/oxidizer element and a smoke generating element. Each of the igniter element, the fuel/oxidizer element, and the smoke generating element is configured in a layered configuration such that impact of the igniter element causes ignition of the fuel/oxidizer element and further causes the smoke generating element to release a visible smoke.

Before the present compounds, compositions, articles, systems, devices, and/or methods are disclosed and described, it is to be understood that they are not limited to specific synthetic methods unless otherwise specified, or to particular reagents unless otherwise specified, as such can, of course, vary. It is also to be understood that the terminology used herein is for the purpose of describing particular aspects only and is not intended to be limiting.

Various combinations of elements of this disclosure are encompassed by this disclosure, e.g., combinations of elements from dependent claims that depend upon the same independent claim.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of embodiments described in the specification.

All publications mentioned herein are incorporated herein by reference to disclose and describe the methods and/or materials in connection with which the publications are cited.

Definitions

It is also to be understood that the terminology used herein is for the purpose of describing particular aspects only and is not intended to be limiting. As used in the specification and in the claims, the term "comprising" can include the embodiments "consisting of" and "consisting essentially of." Unless defined otherwise, all technical and scientific terms used herein have the same meaning as commonly understood by one of ordinary skill in the art to which this disclosure belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to a remote ignition device including "an igniter packet" includes a remote ignition device including two or more igniter packets.

As used herein, the term "combination" is inclusive of blends, mixtures, alloys, reaction products, and the like.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

Disclosed are the components to be used to prepare the compositions of the disclosure as well as the compositions themselves to be used within the methods disclosed herein. These and other materials are disclosed herein, and it is understood that when combinations, subsets, interactions, groups, etc. of these materials are disclosed that while specific reference of each various individual and collective combinations and permutation of these compounds cannot be explicitly disclosed, each is specifically contemplated and described herein. For example, if a particular compound is disclosed and discussed and a number of modifications that can be made to a number of molecules including the compounds are discussed, specifically contemplated is each and every combination and permutation of the compound and the modifications that are possible unless specifically indicated to the contrary. Thus, if a class of molecules A, B, and C are disclosed as well as a class of molecules D, E, and F and an example of a combination molecule, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the compositions of the disclosure. Thus, if there are a variety of additional steps that can be performed it is understood that each of these additional steps can be performed with any specific aspect or combination of aspects of the methods of the disclosure.

References in the specification and concluding claims to parts by weight of a particular element or component in a composition or article, denotes the weight relationship between the element or component and any other elements or components in the composition or article for which a part by weight is expressed. Thus, in a compound containing 2 parts by weight of component X and 5 parts by weight component Y, X and Y are present at a weight ratio of 2:5, and are present in such ratio regardless of whether additional components are contained in the compound.

A weight percent of a component, unless specifically stated to the contrary, is based on the total weight of the formulation or composition in which the component is included.

As used herein the terms "weight percent," "wt %," and "wt. %," which can be used interchangeably, indicate the percent by weight of a given component based on the total weight of the composition, unless otherwise specified. That is, unless otherwise specified, all wt % values are based on the total weight of the composition. It should be understood that the sum of wt % values for all components in a disclosed composition or formulation are equal to 100.

Each of the materials disclosed herein are either commercially available and/or the methods for the production thereof are known to those of skill in the art.

It is understood that the compositions disclosed herein have certain functions. Disclosed herein are certain structural requirements for performing the disclosed functions and it is understood that there are a variety of structures that can perform the same function that are related to the disclosed structures, and that these structures will typically achieve the same result.

Remote Ignition Device

Figure 1B:
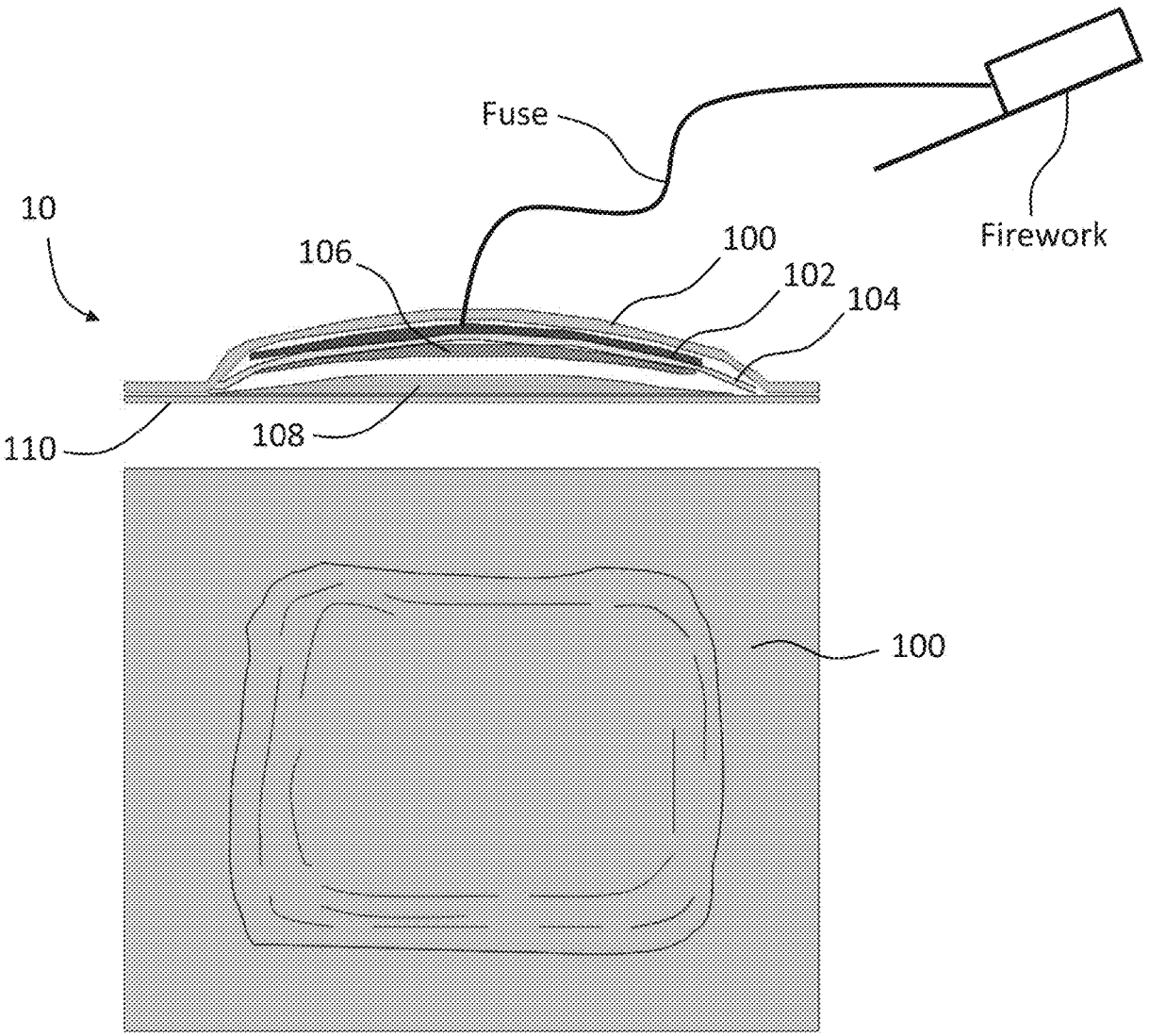

In an aspect, a remote ignition device 10 may include an igniter element 102, a fuel/oxidizer element 106 and a smoke generating element 108 as shown in FIGS. 1A and 1B. In some aspects, as illustrated, the igniter element 102 may be disposed at the top of the assembled remote ignition device; in other words, the igniter element 102 is facing outwards from the assembled remote ignition device such that it is configured to face the direction from which a projectile would strike the remote ignition device 10. A first separating layer 104 separates the igniter element 102 from the fuel/oxidizer element 106 and the smoke generating element 108. Also as shown in FIG. 1A, in certain aspects the fuel/oxidizer element 106 may be disposed adjacent (underneath) the igniter element 102, and the smoke generating element 108 may be disposed adjacent (underneath) the fuel/oxidizer element 106, with a second separating layer 116 disposed between the fuel/oxidizer element 106 and the smoke generating element 108. In other aspects illustrated in FIG. 1B, the fuel/oxidizer element 106 and the smoke generating element 108 may be disposed such that they are not separated from one another; in other words there is no second separating layer between the fuel/oxidizer element 106 and the smoke generating element 108.

The first separating layer 104 and second separating layer 116 may be any material that prevents contact between the elements separated by the respective separating layer. Exemplary materials for the first separating layer and the second separating layer include, but are not limited to, foil tape, polyester film (e.g., Mylar®), polyimide film (e.g., Kapton®), polyethylene terephthalate (PET) film, and combinations thereof.

Figure 2:
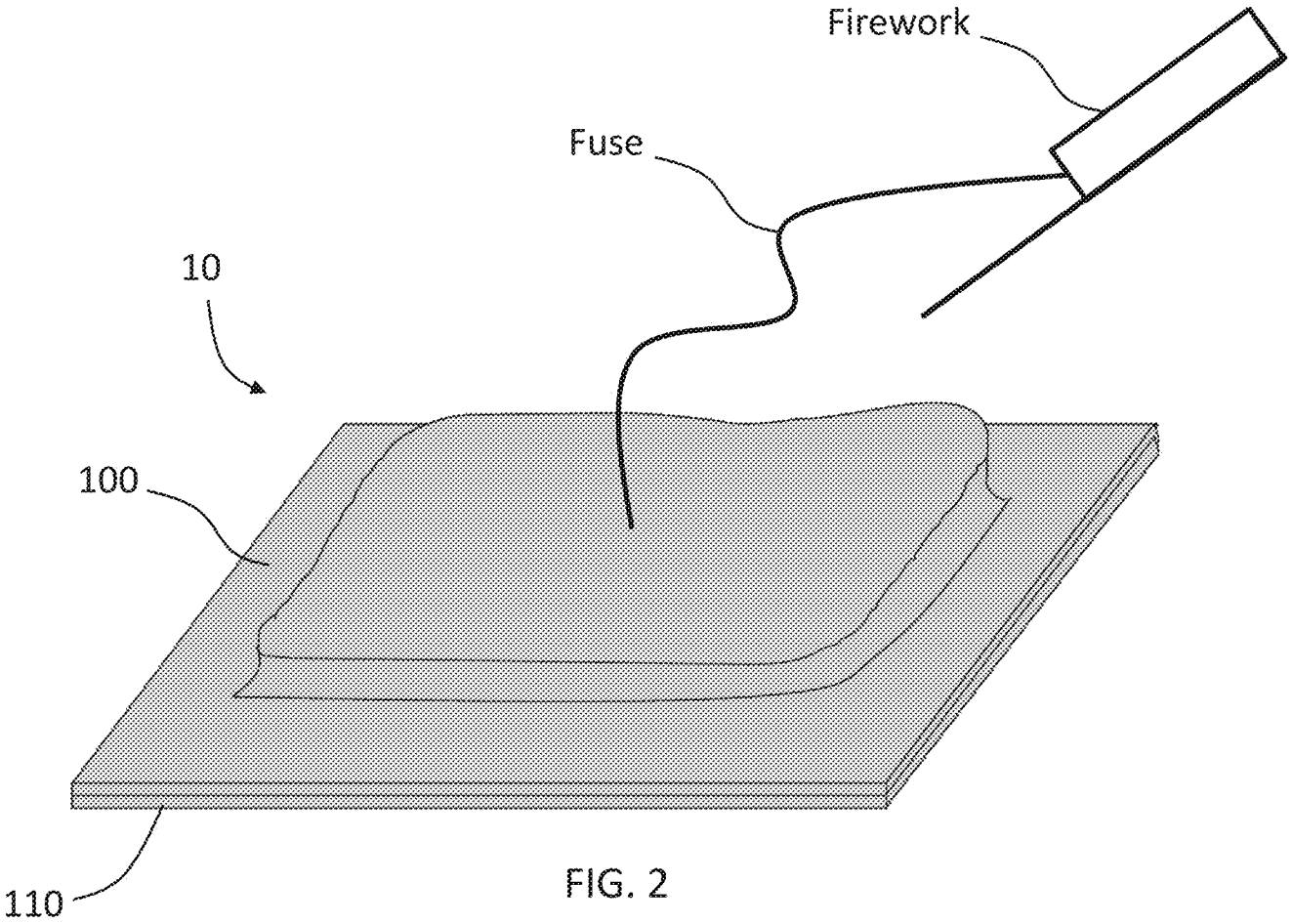
FIG. 2 provides an isometric view of an example remote ignition device according to an aspect of the disclosure.

The igniter element 102, the fuel/oxidizer element 106 and the smoke generating element 108 may be retained in the remote ignition device 10 by a top cover 100 and a bottom substrate 110. The top cover 100 and bottom substrate 110 may be formed of any material suitable for retaining and protecting the elements within the remote ignition device 10. Exemplary materials include, but are not limited to, those materials listed above for the separating layers: foil tape, polyester film (e.g., Mylar®), polyimide film (e.g., Kapton®), polyethylene terephthalate (PET) film, and combinations thereof. One or both of the top cover 100 and the bottom substrate 110 may include an adhesive for joining the edges of the top cover 100 to the bottom substrate 110 and retaining the igniter element 102, the fuel/oxidizer element 106, and the smoke generating element 108 therein. Alternatively, an adhesive may be applied to one or both of the top cover 100 and the bottom substrate 110 during assembly of the remote ignition device 10 so that the edges of the top cover 100 and the bottom substrate 110 may be joined to one another and retain the igniter element 102, the fuel/oxidizer element 106, and the smoke generating element 108 therein. An assembled remote ignition device 10 is illustrated in FIG. 2.

In certain aspects each of the igniter element 102, the fuel/oxidizer element 106 and the smoke generating element 108 are in the form of a packet. The packet may be a package, pouch or other suitable means for retaining the individual components of the elements prior to assembly in the remote ignition device 10. In this manner, the individual elements can be easily prepared separately and then assembled into the remote ignition device 10 as described herein. The packet material may be any material suitable for retaining the elements therein.

In particular aspects the igniter element 102 is located in an igniter packet separate from the fuel/oxidizer element 106 and the smoke generating element 108.

In some aspects the fuel/oxidizer element 106 is located in a fuel/oxidizer packet and the smoke generating element 108 is located in a separate smoke generating packet. In other words, the fuel/oxidizer element 106 and the smoke generating element 108 do not make direct contact with one another. In other aspects the fuel/oxidizer element 106 and the smoke generating element 108 are located together in a pyrotechnics packet, i.e., the materials of the fuel/oxidizer element 106 and the smoke generating element 108 are co-located in the same packet and directly contact each other.

As configured herein, a bullet or other projectile impacts the igniter element 102, initiating combustion. In some aspects heat from combustion of the igniter element 102 initiates combustion of the fuel/oxidizer element 106, and heat from combustion of the fuel/oxidizer element 106 initiates combustion of the smoke generating element 108. In other aspects, however, heat from combustion of the igniter element 102 initiates combustion of both the fuel/oxidizer element 106 and the smoke generating element 108. In one aspect combustion of the igniter element 102 can be initiated with as little as about 0.1 Joule of energy. In further aspects combustion of the igniter element 102 can be initiated, for example, with as little as about 0.2 Joule of energy, or about 0.5 Joule of energy, or about 0.75 Joule of energy, or about 1.0 Joule of energy. In a particular aspect, combustion of the igniter element 102 can be initiated, for example, by impact with a 0.3 gram bb-gun pellet or air-soft gun pellet at a speed of about 300 foot per second.

The igniter element 102 may include ingredients that will ignite and/or combust under low impact and become the initial source of heat for the remote ignition device 10. In a particular aspect, a mixture of approximately 0.650 grams (g) includes 38.4 wt. % red phosphorous (reducing agent, heats upon impact), 19.2 wt. % fine glass beads (friction agent), 3.1 wt. % carbon black (heat distributor), 3.8 wt. % calcium carbonate $CaCO_3$ (neutralizer) and 35.4 wt. % binder (holds material together). In more general aspects, the igniter element 102 may include from about 25-60 wt. % of a phosphorous component (e.g., red phosphorous), from about 10-50 wt. % of a filler (including but not limited to glass beads), from about 1-10 wt. % carbon black, from about 1-10 wt. % of a neutralizer, and from about 10-45 wt. % of a binder. Neutralizers stabilize the mixture and moderate the burn rate. Suitable neutralizers in addition to $CaCO_3$ include, but are not limited to, $NaHCO_3$, $MgCO_3$, and combinations thereof. Suitable binders include, but are not limited to, gums and resins such as but not limited to animal glue, starch, epoxies, polyurethanes, styrene-butadiene rubbers, latexes, acrylics, polyvinyl acrylates, and combinations thereof. The binder may also serve as a fuel. In some aspects it may be desirable to use a moisture-free binder so as to reduce or eliminate the need to dry the igniter element 102 after assembly.

The fuel/oxidizer element 106 may include ingredients that will provide combustion heat to ignite the smoke generating element. In a particular aspect, a mixture of approximately 0.98 g includes 19.1 wt. % potassium chlorate ($KClO_3$) (oxidizer), 13 wt. % charcoal (fuel-slower burn rate, higher temperature than wood), 10 wt. % wood dust (fuel-faster burning than charcoal), 34.4 wt. % $CaCO_3$ (neutralizer), and 23.4 wt. % binder. Oxidizers vaporize the dye in the smoke generating element and, together with the fuel components, generate $CO_2$ and water vapor gases to disperse the dye (i.e., create smoke). In more general aspects, the fuel/oxidizer element 106 may include from about 15-40 wt. % of an oxidizer, from about 0-25 wt. % charcoal, from about 0-25 wt. % wood dust, from about 2-45 wt. % neutralizer and from about 5-45 wt. % binder. Alternative or additional oxidizers include, but are not limited to, potassium nitrate ($KNO_3$), potassium perchlorate ($KClO_4$), ammonium nitrate ($NH_4NO_3$), ammonium perchlorate ($NH_4ClO_4$), iron oxide ($Fe_3O_4$), barium nitrate $Ba(NO_3)_2$, barium chromate ($BaCrO_4$), red lead oxide ($Pb_3O_4$), polytetrafluoroethylene (PTFE), periodate salts (e.g., potassium periodate $KIO_4$, sodium periodate $NaIO_4$) and combinations thereof. Alternative fuels include, but are not limited to, metals (e.g., aluminum, magnesium, iron, steel, zirconium, titanium, manganese, zinc, copper, brass, tungsten), metal hydrides, metal carbides, metalloids (e.g., silicon, boron, antimony), inorganics (e.g., sulfur, calcium silicide, antimony trisulfide, arsenic sulfide), and combinations thereof. A neutralizer may be used to moderate the burn rate (e.g., $CaCO_3$, $NaHCO_3$ or $MgCO_3$). Suitable binders include, but are not limited to, gums and resins such as but not limited to animal glue, starch, epoxies, polyurethanes, styrene-butadiene rubbers, latexes, acrylics, polyvinyl acrylates, and combinations thereof. The binder may also serve as a fuel.

The smoke generating element 108 may include ingredients that will provide smoke for the remote ignition device 10. In a particular aspect, a mixture of approximately 0.45 g includes 44.3 wt. % potassium nitrate ($KNO_3$) (oxidizer), 28.4 wt. % sugar (fuel), 7.2 wt. % baking soda ($NaHCO_3$) (neutralizer) and 20.1 wt. % organic dye (e.g., anthroquinone or quinoline). In more general aspects, the smoke generating element 108 may include from about 20-65 wt. % of an oxidizer, from about 10-60 wt. % of a sugar, from about 0-45 wt. % of a neutralizer and from about 10-60 wt. % of an organic dye. Alternative or additional oxidizers include, but are not limited to, potassium chlorate ($KClO_3$), potassium perchlorate ($KClO_4$), ammonium nitrate ($NH_4NO_3$), ammonium perchlorate ($NH_4ClO_4$), iron oxide ($Fe_3O_4$), barium nitrate $Ba(NO_3)_2$, barium chromate ($BaCrO_4$), red lead oxide ($Pb_3O_4$), polytetrafluoroethylene (PTFE), periodate salts (e.g., $KIO_4$, $NaIO_4$) and combinations thereof. In the case of $KNO_3$ as the oxidizer and sugar as the fuel, the mixture may be bound by heating. In some other aspects heat will not bind the mixture and a separate binder may be required. Suitable binders include, but are not limited to, gums and resins such as but not limited to animal glue, starch, epoxies, polyurethanes, styrene-butadiene rubbers, latexes, acrylics, polyvinyl acrylates, and combinations thereof. The binder may also serve as a fuel. Suitable neutralizers in addition to $NaHCO_3$ include, but are not limited to, $CaCO_3$, $MgCO_3$ and combinations thereof. A desired smoke color may be achieved by use of an appropriate organic dye (e.g., Orange: a-xylene-αzo-β-naphthol, green: 1,4-di-p-toluidino-anthraquinone, red: 1-methylamino-anthraquinone, violet: 1,4-diamino-2,3-dihydroanthraquinone).

Methods of Making Smoking Remote Ignition Device

Aspects of the disclosure further relate to methods of making a remote ignition device including: disposing a fuel/oxidizer element 106 and a smoke generating element 108 adjacent an igniter element 102; and packaging each of the fuel/oxidizer element 106, the smoke generating element 108, and the igniter element 102 in a stacked configuration such that impact of the igniter element 102 causes ignition of the fuel/oxidizer element 106 and further causes the smoke generating element 108 to release a visible smoke.

In some aspects, the igniter element 102, the fuel/oxidizer element 106 and the smoke generating element 108 are formed by depositing the ingredients for each element onto a bottom substrate 110. The bottom substrate 110 may be, but does not have to be, formed of any of the materials described above. In one aspect the bottom substrate 110 is metallic foil tape (e.g., 2 inch aluminum foil tape) having an adhesive backing that is exposed when a release layer is removed.

In one exemplary method, the ingredients for the smoke generating element 108 are deposited in the center of the bottom substrate 110. Accordingly, the adhesive perimeter of the bottom substrate 110 is exposed, allowing the fuel/oxidizer element 106 and then the igniter element 102 to be attached. One or both of the first separating layer 104 and the second separating layer 116 may be applied to the remote ignition device 10 as applicable. The top cover 100 may then be applied to cover and seal the components. In some aspects it may be desirable to completely seal the entire remote ignition device 10 and enclose the igniter element 102, the fuel/oxidizer element 106 and the smoke generating element 108 therein to create a seal that withstands the impact of the projectile. This will limit exposure of the combustible ingredients to surrounding air, and ensure that the only air entering the remote ignition device 10 is from the projectile hole, thereby reducing the burn rate of components, which will minimize flaming, increase the production of smoke, and increase the duration of smoke response. In an aspect, a bottom substrate 110 of an aluminum foil tape material with a perimeter seal of 0.375 inch is sufficient to withstand the impact of projectiles. In the case of an intermediate element, the perimeter seal can be omitted, leaving the top and bottom elements to form the contiguous seal around the assembly.

It will be recognized that the elements may be placed in any order in the remote ignition device 10. Purely by way of example, the igniter element 102 may be laid against the bottom substrate 110, followed by the fuel/oxidizer element 106 and then the smoke generating element 108.

With specific reference to assembly of the smoke generating element 108, in an aspect the ingredients of this element are mixed with a binder (if used), spread out evenly on the bottom substrate 110, leaving a clear border (of, e.g., approximately 0.375 inch) for sealing and joining with the igniter element 102 and fuel/oxidizer element 106, and then air dried if necessary. In some aspects it may be desirable to use moisture-free ingredients to the extent possible so as to reduce or eliminate the need to dry the smoke generating element after assembly. If a second separating layer 116 is used, it may be applied over the smoke generating element 108.

With specific reference to assembly of the fuel/oxidizer element 106, in an aspect the ingredients are mixed with a binder, spread out evenly on the second separating layer 116 (if used) or the smoke generating element 108 (if a second separating layer 116 is not used), and then air dried prior to assembly if necessary. In some aspects it may be desirable to use moisture-free ingredients to the extent possible so as to reduce or eliminate the need to dry the fuel/oxidizer element after assembly.

With specific reference to assembly of the igniter element 102, in an aspect, following assembly of the fuel/oxidizer element 106 and the smoke generating element 108, the first separating layer 104 may be applied over the fuel/oxidizer element 106 and the smoke generating element 108. The ingredients of the igniter element may then be applied onto the first separating layer 104, leaving a clear border (of, e.g., approximately 0.375 inch) for allowing the top cover 100 to be applied over the assembled components, and then air dried prior to assembly if necessary. In some aspects it may be desirable to use moisture-free ingredients to the extent possible so as to reduce or eliminate the need to dry the igniter element after assembly.

While the method described above contemplates assembly of all components of the remote ignition device 10 at a single location, e.g., a manufacturing facility, in some aspects it may be desirable to partially assemble the remote ignition device in one location (e.g., a manufacturing facility) and then complete assembly of the remote ignition device 10 in the field for enhanced safety reasons, as inadvertent impact of a remote ignition device 10 could result in its ignition. In such aspects, the fuel/oxidizer element 106 and the smoke generating element 108 may be pre-assembled, but the igniter element 102 is assembled into the remote ignition device 10 on-site.

Alternative element (fuel, igniter and/or smoke generating) sizes may be employed by creating larger sections of bottom substrate and increasing, proportionately, the amounts of components added to the remote ignition device 10, with the general effect of decreased granularity of the target with increased element size.

Figure 3:
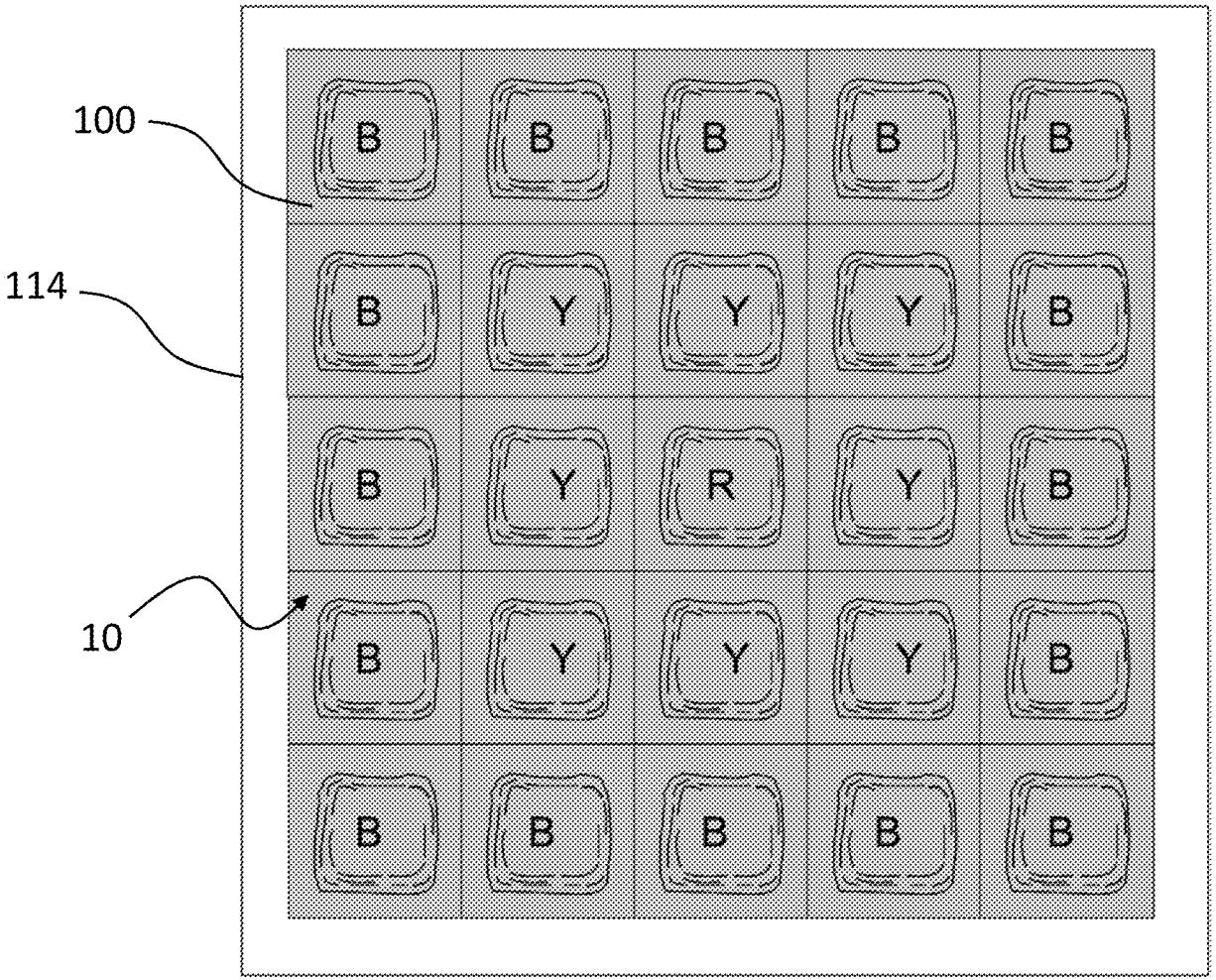
FIG. 3 is a diagrammatic view of a remote ignition device target array according to an aspect of the disclosure comprising 25 sections with varying smoke color indicating hit position, with "B" indicating blue, "Y" indicating yellow and "R" indicating red.
Figure 4:
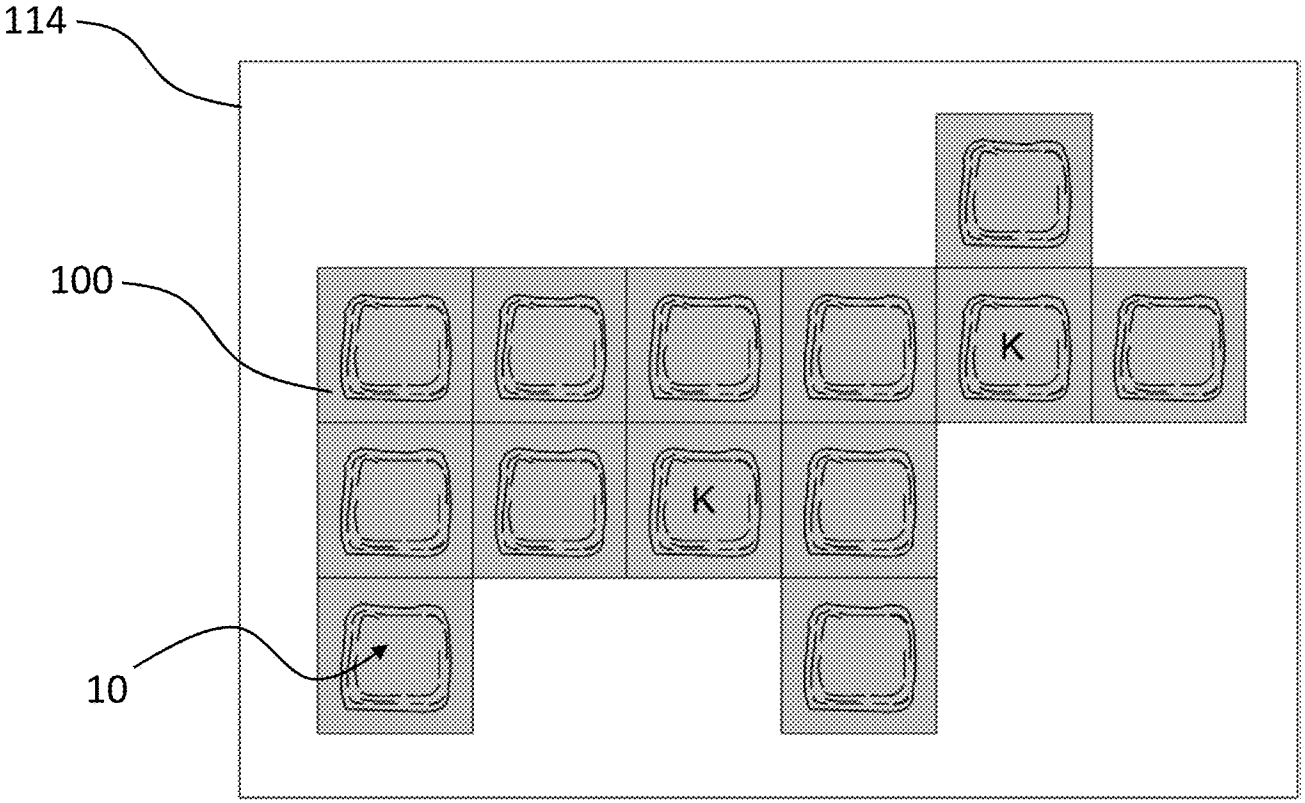
FIG. 4 is a diagrammatic view of an animal-shaped target with a kill zone indicating smoke color.

Use of the remote ignition device 10 described herein provides options for flexible target shapes at a low cost. In one aspect illustrated in FIG. 3, an array of remote ignition devices 10 having different smoke colors are assembled onto a target board 114, whereby smoke color indicates hit accuracy. In other aspects, multiple remote ignition devices 10 are assembled onto the target board 114 into a shape, such as an animal shape as shown in FIG. 4. In one aspect generated smoke color in a certain remote ignition device 10 indicates a "kill zone" hit ("K") or a less accurate hit (other remote ignition devices 10). Accordingly, a single target may include multiple remote ignition devices, each device configured to generate a colored smoke upon impact, for example.

In use, an operator (the target shooter) fires a projectile (e.g., from a firearm) at a selected distance, and when the target is impacted the remote ignition device 10 begins combustion. With the element ingredients and as assembled according to aspects described herein, exposure of the elements to air is limited to the hole created by the projectile (bullet), which limits the burn rate, producing minimal or no visual flame and a long-lasting smoke trail. Smoke trails from the remote ignition device 10 of the present disclosure have been observed to last in excess of 25 seconds, allowing time for the shooter to fully identify the hit and alert other shooters to observe the hit.

As described herein, a remote ignition device may provide a visual indication of a strike. In further aspects, the disclosed remote ignition device includes an igniter element that may ignite upon impact. These attributes make the disclosed remote ignition devices useful in a number of applications, such as a shooting target as provided herein. In a further example (not illustrated), and not intended to be limiting, a remote ignition device described herein may be used to initiate combustion of a firework. In such aspects, the igniter element (or similar element) alone, or in combination with the fuel/oxidizer element (or similar element) is used to initiate combustion of a firework, thereby allowing the remote ignition of the firework from a distance, using an impact (e.g., a bb-gun). In one aspect, the igniter element is attached to the fuse of a firework. In another aspect, the igniter element components are prepared as described herein and then applied into the core of a firework and optionally a portion of the outside of the firework, serving as both source of ignition by impact, as well as initiating the combustion of the firework (i.e., the igniter element components replace the fuse of the firework).

In a further non-limiting aspect, the disclosed remote ignition device may be used to initiate combustion of a firework wherein the firework comprises a propellant along with the materials or variations of such materials as described herein. For example, similar to the above example in which the igniter element (or similar element) alone, or in combination with the fuel/oxidizer element (or similar element) is used to initiate the combustion of a firework (such as when the combustion is initiated), the firework is discharged in a manner that visual indications are released. Such visual indications may be similar to the visual indications present in the example of using the remote ignition device as a target. For example, the visual indication may include smoke, or a colored smoke. In this aspect, however, the visual indications of the remote ignition device may not necessarily appear in the vicinity of the remote ignition device, but rather may appear at a distance from the remote ignition device depending on the type and amount of propellant used. Alternatively, the visual indications may be seen as substantially a continuum from the location of the remote ignition device along the flight path of the firework as the firework travels from its initial location until the visual indication is no longer visible.

Various combinations of elements of this disclosure are encompassed by this disclosure, e.g., combinations of elements from dependent claims that depend upon the same independent claim.

Aspects of the Disclosure

In various aspects, the present disclosure pertains to and includes at least the following aspects.

Aspect 1: A remote ignition device comprising:

a. an igniter element;

b. a fuel/oxidizer element; and c. a smoke generating element, wherein each of the igniter element, the fuel/oxidizer element, and the smoke generating element is configured in a layered configuration such that impact of the igniter element causes ignition of the fuel/oxidizer element and further causes the smoke generating element to release a visible smoke.

Aspect 2: The remote ignition device of Aspect 1, wherein each of the igniter element, the fuel/oxidizer element and the smoke generating element are in a form of a packet.

Aspect 3: The remote ignition device of Aspect 1, wherein the igniter element is located in an igniter packet separate from the fuel/oxidizer element and the smoke generating element.

Aspect 4: The remote ignition device of Aspect 3, wherein the fuel/oxidizer element is located in a fuel/oxidizer packet and the smoke generating element is located in a separate smoke generating packet.

Aspect 5: The remote ignition device of Aspect 3, wherein the fuel/oxidizer element and the smoke generating element are located together in a pyrotechnics packet.

Aspect 6: The remote ignition device of Aspect 1, wherein the igniter element is located in an igniter packet, the fuel/oxidizer element is located in a fuel/oxidizer packet and the smoke generating element is located in a smoke generating packet, and the fuel/oxidizer packet is disposed adjacent the igniter packet and the smoke generating packet is disposed adjacent the fuel/oxidizer packet.

Aspect 7: The remote ignition device of Aspect 1, further comprising a bottom substrate, wherein one or more of the igniter element, the fuel/oxidizer element, and the smoke generating element is secured to the bottom substrate.

Aspect 8: The remote ignition device of Aspect 7, wherein the bottom substrate comprises an adhesive.

Aspect 9: A remote ignition device comprising:

a. an igniter element configured to face a source of a projectile; and b. a fuel/oxidizer element and a smoke generating element disposed adjacent the igniter element, wherein each of the igniter element, the fuel/oxidizer element, and the smoke generating element is configured in a stacked configuration such that impact of the igniter element causes ignition of the fuel/oxidizer element and further causes the smoke generating element to release a visible smoke.

Aspect 10: The remote ignition device of Aspect 9, wherein each of the igniter element, the fuel/oxidizer element and the smoke generating element are in a form of a packet.

Aspect 11: The remote ignition device of Aspect 10, wherein the fuel/oxidizer element is located in a fuel/oxidizer packet and the smoke generating element is located in a separate smoke generating packet.

Aspect 12: The remote ignition device of Aspect 10, wherein the fuel/oxidizer element and the smoke generating element are located together in a pyrotechnics packet.

Aspect 13: The remote ignition device of Aspect 9, wherein the igniter element is located in an igniter packet, the fuel/oxidizer element is located in a fuel/oxidizer packet and the smoke generating element is located in a smoke generating packet, and the fuel/oxidizer packet is disposed adjacent the igniter packet and the smoke generating packet is disposed adjacent the fuel/oxidizer packet.

Aspect 14: The remote ignition device of Aspect 9, further comprising a bottom substrate, wherein one or more of the igniter element, the fuel/oxidizer element, and the smoke generating element is secured to the bottom substrate.

Aspect 15: The remote ignition device of Aspect 14, wherein the bottom substrate comprises an adhesive.

Aspect 16: A method of making a remote ignition device comprising:

a. disposing a fuel/oxidizer element and a smoke generating element adjacent an igniter element; and b. packaging each of the fuel/oxidizer element, the smoke generating element, and the igniter element in a stacked configuration such that impact of the igniter element causes ignition of the fuel/oxidizer element and further causes the smoke generating element to release a visible smoke.

Aspect 17: The method of Aspect 16, wherein the igniter element is located in an igniter packet separate from the fuel/oxidizer element and the smoke generating element.

Aspect 18: The method of Aspect 16, wherein the fuel/oxidizer element is located in a fuel/oxidizer packet and the smoke generating element is located in a separate smoke generating packet.

Aspect 19: The method of Aspect 16, wherein the fuel/oxidizer element and the smoke generating element are located together in a pyrotechnics packet.

Aspect 20: The method of Aspect 16, wherein the igniter element is located in an igniter packet, the fuel/oxidizer element is located in a fuel/oxidizer packet and the smoke generating element is located in a smoke generating packet, and the fuel/oxidizer packet is disposed adjacent the igniter packet and the smoke generating packet is disposed adjacent the fuel/oxidizer packet.

Aspect 21: A remote ignition device comprising: an igniter element comprising about 25-60 wt. % red phosphorous, about 10-50 wt. % glass beads, about 1-10 wt. % carbon black, about 1-10 wt. % neutralizer, and about 10-45 wt. % binder; a fuel/oxidizer element comprising about 15-40 wt. % $KClO_3$, about 0-25 wt. % charcoal, about 0-25 wt. % wood dust, about 2-45 wt. % neutralizer and about 5-45 wt. % binder, the fuel/oxidizer element disposed adjacent the igniter element; and a smoke generating element comprising about 20-65 wt. % $KNO_3$, about 10-60 wt. % sugar, about 0-45 wt. % $NaHCO_3$ and about 10-60 wt. % organic dye, the smoke generating element disposed adjacent the fuel/oxidizer element, wherein each of the igniter element, the fuel/oxidizer element, and the smoke generating element is configured in a layered configuration such that impact of the igniter element causes ignition of the fuel/oxidizer element and further causes the smoke generating element to release a visible smoke.

Aspect 22: A remote ignition device comprising: an igniter element comprising 38.4 wt. % red phosphorous, 19.2 wt. % fine glass beads, 3.1 wt. % carbon black, 3.8 wt. % $CaCO_3$ and 35.4 wt. % binder; a fuel/oxidizer element comprising 19.1 wt. % potassium chlorate ($KClO_3$), 13 wt. % charcoal, 10 wt. % wood dust, 34.4 wt. % $CaCO_3$, and 23.4 wt. % binder, the fuel/oxidizer element disposed adjacent the igniter element; and a smoke generating element comprising 44.3 wt. % potassium nitrate ($KNO_3$), 28.4 wt. % sugar, 7.2 wt. % baking soda ($NaHCO_3$) and 20.1 wt. % organic dye, the smoke generating element disposed adjacent the fuel/oxidizer element, wherein each of the igniter element, the fuel/oxidizer element, and the smoke generating element is configured in a layered configuration such that impact of the igniter element causes ignition of the fuel/oxidizer element and further causes the smoke generating element to release a visible smoke.

Aspect 23: A remote ignition device comprising: an igniter element comprising 38.4 wt. % reducing agent configured to heat upon impact, 19.2 wt. % friction agent, 3.1 wt. % heat distributor, 3.8 wt. % neutralizer and 35.4 wt. % binder; a fuel/oxidizer element comprising 19.1 wt. % oxidizer, 13 wt. % fuel having slower burn rate, higher temperature than wood, 10 wt. % fuel having faster burning than charcoal, 34.4 wt. % neutralizer, and 23.4 wt. % binder, the fuel/oxidizer element disposed adjacent the igniter element; and a smoke generating element comprising 44.3 wt. % oxidizer, 28.4 wt. % fuel, 7.2 wt. % neutralizer and 20.1 wt. % organic dye, the smoke generating element disposed adjacent the fuel/oxidizer element, wherein each of the igniter element, the fuel/oxidizer element, and the smoke generating element is configured in a layered configuration such that impact of the igniter element causes ignition of the fuel/oxidizer element and further causes the smoke generating element to release a visible smoke.

Aspect 24: A remote ignition device comprising: an igniter element comprising about 25-60 wt. % reducing agent configured to heat upon impact, about 10-50 wt. % friction agent, about 1-10 wt. % heat distributor, about 1-10 wt. % neutralizer and about 10-45 wt. % binder; a fuel/oxidizer element comprising about 15-40 wt. % oxidizer, about 0-25 wt. % of a fuel having a slower burn rate and a higher burn temperature than wood, about 0-25 wt. % fuel having faster burn rate than charcoal, about 2-45 wt. % neutralizer, and about 5-45 wt. % binder, the fuel/oxidizer element disposed adjacent the igniter element; and a smoke generating element comprising about 20-65 wt. % oxidizer, about 10-60 wt. % fuel, about 0-45 wt. % neutralizer and about 10-60 wt. % organic dye, the smoke generating element disposed adjacent the fuel/oxidizer element, wherein each of the igniter element, the fuel/oxidizer element, and the smoke generating element is configured in a layered configuration such that impact of the igniter element causes ignition of the fuel/oxidizer element and further causes the smoke generating element to release a visible smoke.

Aspect 25: A remote ignition device comprising: a. an igniter element; b. a fuel/oxidizer element; and c. a smoke generating element, wherein each of the igniter element, the fuel/oxidizer element, and the smoke generating element is configured in a layered configuration such that impact of the igniter element causes ignition of the fuel/oxidizer element and further causes the smoke generating element to release a visible smoke, wherein the remote ignition device comprises a target for shooting.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

That which is claimed is:

1. A target comprising a remote ignition device comprising:

a. an igniter element in a form of a first packet; and b. a fuel/oxidizer element and a smoke generating element in a form of a second packet, wherein the first packet comprises a first position that is physically separate from the second packet such that ignition of the igniter element prevents inadvertent ignition of the fuel/oxidizer element and the smoke generating element, wherein the first packet comprises a second position relative to the second packet that is proximate the second packet and which causes ignition of the fuel/oxidizer element and the smoke generating element upon impact of the igniter element by a projectile, wherein ignition of the smoke generating element releases a visible smoke, and wherein the igniter element is configured to be attached to a fuse of a firework so as to allow remote ignition of the firework from a distance.

2. The target of claim 1, further comprising a wherein one or more of the igniter element, the fuel/oxidizer element, and the smoke generating element is secured to a bottom substrate.

3. The target of claim 2, wherein the bottom substrate comprises an adhesive.

4. The target of claim 1, comprising a plurality of remote ignition devices, wherein at least one of the plurality of remote ignition devices releases a visible smoke upon ignition that has a different color than that of a smoke generating element of another of the plurality of remote ignition devices.

5. The target of claim 1, wherein the projectile is a bb-gun pellet, a pellet gun pellet or an air-soft gun pellet.

6. A method of initiating remote ignition of a firework, comprising:

a. disposing a first packet comprising an igniter element in a first position separate from a second packet comprising a fuel/oxidizer element and a smoke generating element such that ignition of the igniter element prevents ignition of the fuel/oxidizer element and the smoke generating element;

b. arranging the first packet in a second position relative to the second packet that is proximate the second packet such that ignition of the igniter element causes ignition of the fuel/oxidizer element and the smoke generating element and release of a visible smoke from the smoke generating element;

c. providing a fuse of a firework;

d. arranging the fuse proximate the first packet and the second packet; and e. initiating combustion of the firework from a remote distance by causing an impact to the igniter element and igniting the fuse of the firework; and f. wherein causing an impact to the igniter element comprises shooting a projectile at the igniter element.

7. The method of claim 6, wherein one or more of the igniter element, the fuel/oxidizer element, and the smoke generating element is secured to a bottom substrate.

8. The method of claim 7, wherein the bottom substrate comprises an adhesive.

9. The method of claim 6, wherein the projectile is a bb-gun pellet, a pellet gun pellet, or an air-soft gun pellet.

* * * * *